United States Patent [19]

Smith et al.

[11] Patent Number: 5,022,813

[45] Date of Patent: Jun. 11, 1991

[54] STACKER BUNDLER SHUTTLE SYSTEM

[75] Inventors: Clark L. Smith, Belle Mead; Gregory Balcerek, Wayne, both of N.J.

[73] Assignee: Stacker Machine Co., Mountainside, N.J.

[21] Appl. No.: 472,449

[22] Filed: Jan. 24, 1990

Related U.S. Application Data

[63] Continuation of Ser. No. 153,993, Feb. 9, 1988, abandoned, which is a continuation-in-part of Ser. No. 764,242, Aug. 9, 1985, Pat. No. 4,723,883.

[51] Int. Cl.[5] ..... B65H 31/30

[52] U.S. Cl. ..... 414/790; 198/463.3

[58] Field of Search ..... 414/789.9, 790, 790.1, 414/790.7; 198/463.3, 468.6; 271/181, 207, 213, 216

[56] References Cited

U.S. PATENT DOCUMENTS

| | | | |
|---|---|---|---|
| 1,756,920 | 4/1930 | Gollnick et al. | 271/213 |
| 3,164,270 | 1/1965 | Kinker | 414/43 X |
| 3,811,549 | 5/1974 | Preisig | 271/213 X |
| 4,049,259 | 9/1977 | Ventz | 271/151 |
| 4,172,531 | 10/1979 | Müller | 271/181 X |
| 4,618,054 | 10/1986 | Muller | 198/468.6 X |

FOREIGN PATENT DOCUMENTS

| | | | |
|---|---|---|---|
| 769133 | 2/1957 | United Kingdom | 271/207 |

*Primary Examiner*—Robert J. Spar

*Assistant Examiner*—Janice Krizek

*Attorney, Agent, or Firm*—Mathews, Woodbridge & Collins

[57] ABSTRACT

An apparatus for transporting paper sheet material in signature form to an off-line receiving station. The apparatus includes a horizontal frame connected with a stacker at one end and registering with the receiving station at the other end. A conveyor mounted on the frame comprises a plurality of horizontally disposed supported belts which receive signatures from the stacker. The belts are spaced apart to form gaps therebetween. A plurality of tracks are mounted horizontally in the frame and extend from the conveyor to the crosspiece. The tracks are supported and can be raised or lowered. A shuttle carriage having a plurality of connected vertical segments rides on the tracks. The segments can be lifted or lowered. The segments of the carriage are aligned with the gaps between the endless belts so that the carriage can ride freely along the frame. A plurality of horizontally disposed rollers are also mounted on the frame above the tracks which are in longitudinal alignment with the conveyor belts. The carriage further includes an upright member extending above each carriage segment having a vertically disposed roller. The carriage may be provided with a pivotably mounted latch to releasably retain the carriage at the crosspiece and the apparatus may further include a counterweight system for biasing the carriage movement toward the conveyor.

6 Claims, 8 Drawing Sheets

33
12
30
29
29
26
31
29a
30a
28
28
29a
29a
12
30

STACKER BUNDLER SHUTTLE SYSTEM

This application is a continuation of application Ser. No. 153,993, filed Feb. 9, 1988, now abandoned, which is a continuation-in-part of application Ser. No. 764,242, filed Aug. 6, 1985, now U.S. Pat. No. 4,723,883.

BACKGROUND OF THE INVENTION

This invention relates to an apparatus for transporting sheet material from a stacker to a bundler position.

In the past, paper material such as newspaper in signature form has been stacked or assembled on flat tables after printing operations from conveyors or stackers and then moved by hand to another portion of the table for compression and bundling. Such an operation has several disadvantages. Firstly, such hand movement of the stacked signatures requires considerable strength and effort. Secondly, movement of the signatures along the table tends to abrade and damage the lower edges of the signature in contact with the table.

The present invention, on the other hand, provides a stacker to bundler carriage shuttle apparatus which rides on tracks which can be raised or lowered for picking up and transporting signatures from the stacker to an off-line position for compression and bundling. Such apparatus renders insubstantial the effort required to move signatures and reduces damage to the signature.

SUMMARY OF THE INVENTION

In brief, the invention comprises an apparatus for transporting paper sheet material in signature form, as for example, from a stacker machine wherein the signatures are horizontally stacked and ready for compression and bundling. The signatures are transported to a bundler receiving station downstream of the stacker where the signatures are off-line loaded, that is, in a direction normal to the direction of transport. The apparatus includes a horizontal frame connected with the stacker at one end and registering with the bundler receiving station at the other end, the frame having a crosspiece at its terminus. A conveyor is mounted on the frame comprising a plurality of horizontally disposed supported belts which receive signatures from the stacker. The belts are driven by pulleys mounted in columnar hollow housings and the belts are spaced apart to form gaps therebetween. A plurality of tracks are mounted horizontally in the frame and extend from the conveyor to the crosspiece. Means for supporting and raising or lowering the tracks are provided which include a double acting pneumatic cylinder connected by a linkage system to a pair of cross supports which engage the tracks. A shuttle carriage having a plurality of connected vertical segments ride on the tracks and are lifted by the raising and lowering means. The segments of the carriage are aligned with the gaps between the endless belts so that the carriage can ride freely between the crosspiece and the conveyor belts. A plurality of horizontally disposed rollers are also mounted on the frame above the tracks which are in longitudinal alignment with the conveyor belts. The carriage further includes an upright member extending above each carriage segment having a vertically disposed roller mounted thereon.

In use, with the tracks in the lowered position, and the carriage located away from the conveyor belts, signatures in stacked form are conducted to the conveyor. The operator moves the carriage to the conveyor, the top of the carriage segments being below the level of the conveyor belts supporting the signatures. The operator then actuates the means for raising which raises the tracks and segments above the level of the belts to pick up the signature stack. The stack is then moved to the crosspiece and the means for lowering is actuated to bring the top of the segments to their lowered position. The stack then rests on the horizontally disposed rollers and the vertically disposed rollers. The operator then pushes the stacks off-line to the bundler receiving station and the process is repeated.

The carriage may be provided with a pivotably mounted latch to releasably retain the carriage at the crosspiece. The latch has a body, a body extension having a sliding surface, a spring for biasing the body in one direction of movement, and a handle engaging the body for moving it in a direction opposed to the biased direction of movement. The apparatus may further include a counterweight system for biasing the carriage movement toward the conveyor.

DETAILED DESCRIPTION OF THE PREFERRED EMBODIMENTS

Figure 1:
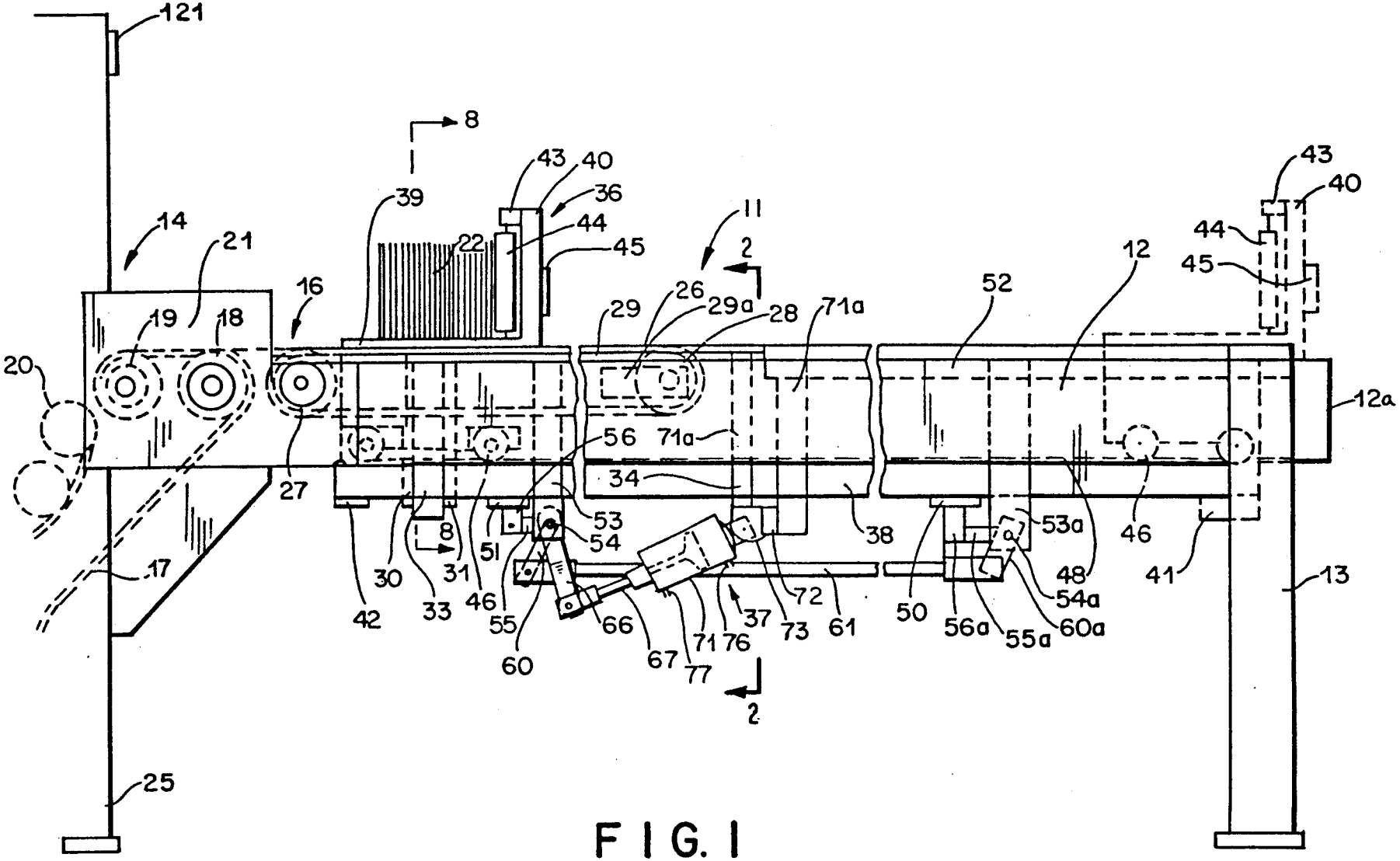
FIG. 1 shows a side view of the shuttle apparatus of the invention.
Figure 2:
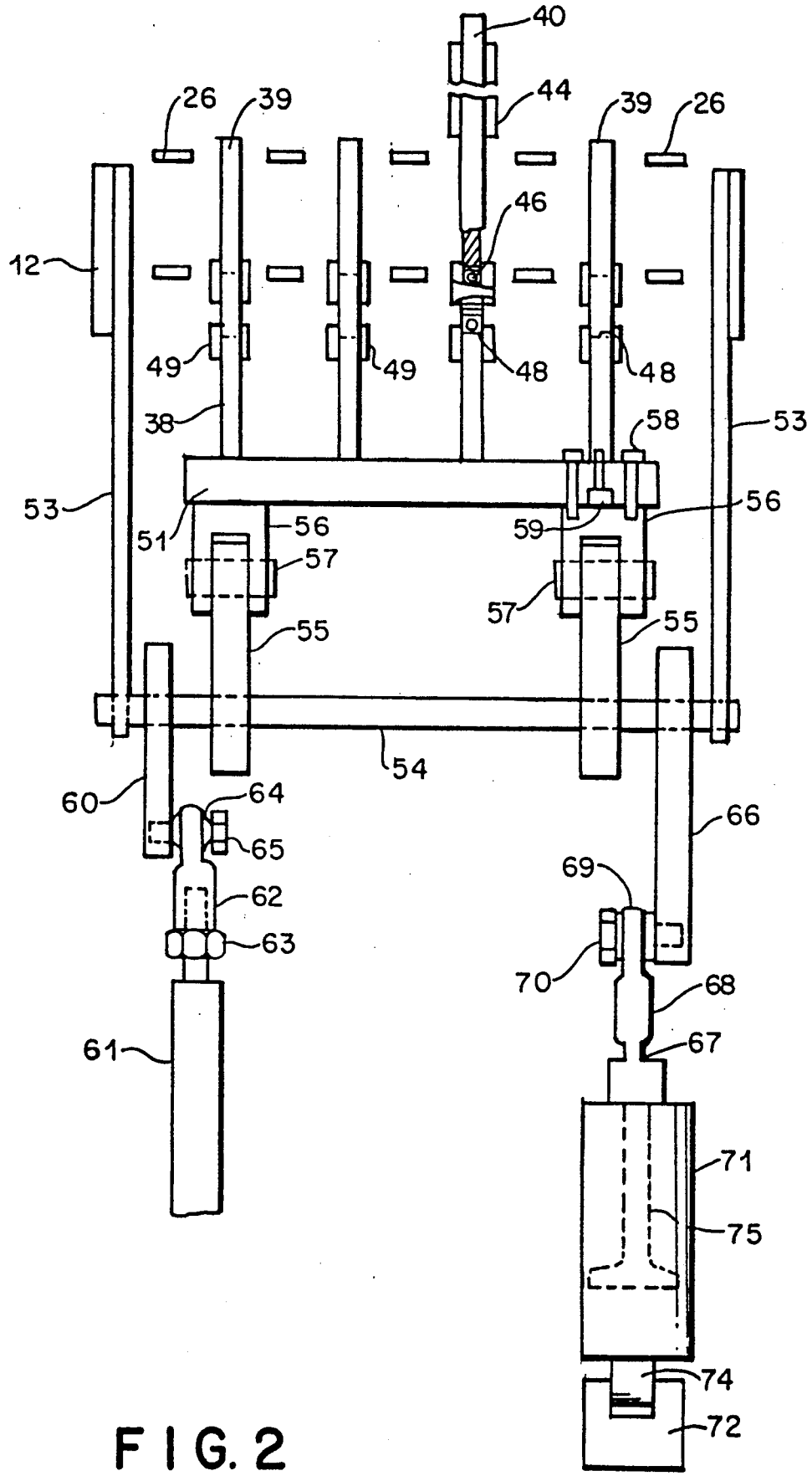
FIG. 2 is a sectional view of a carriage lift apparatus of the invention through line 2—2 of FIG. 1.
Figure 3:
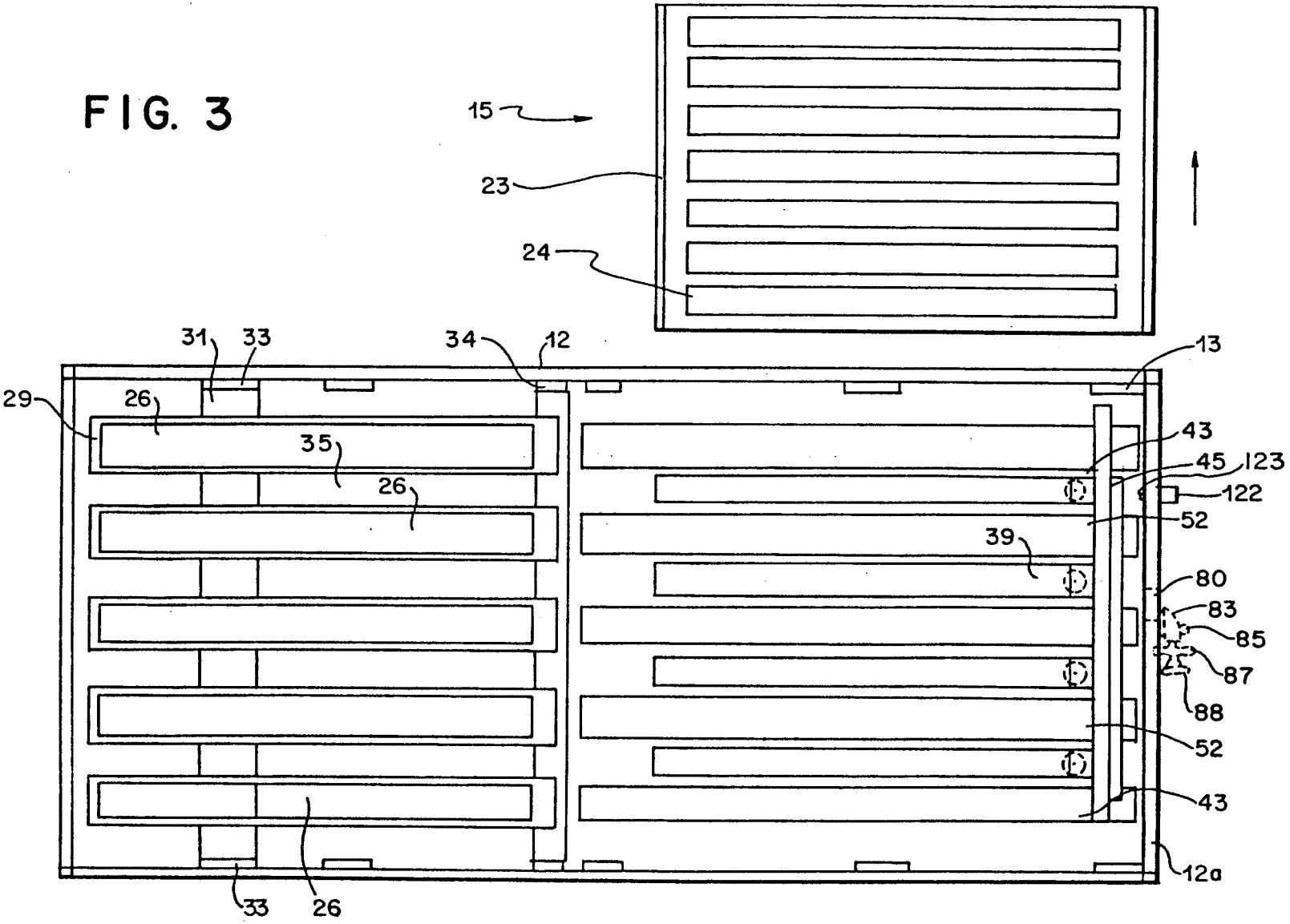
FIG. 3 is a top view of the apparatus of the invention.
Figure 4B:
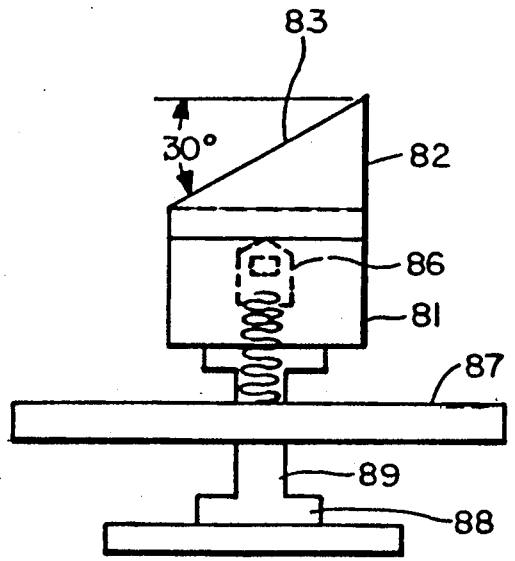
FIGS. 4*a* and 4*b* show an end view and side view, respectively, of a latch mechanism used with the apparatus of the invention.
Figure 4A:
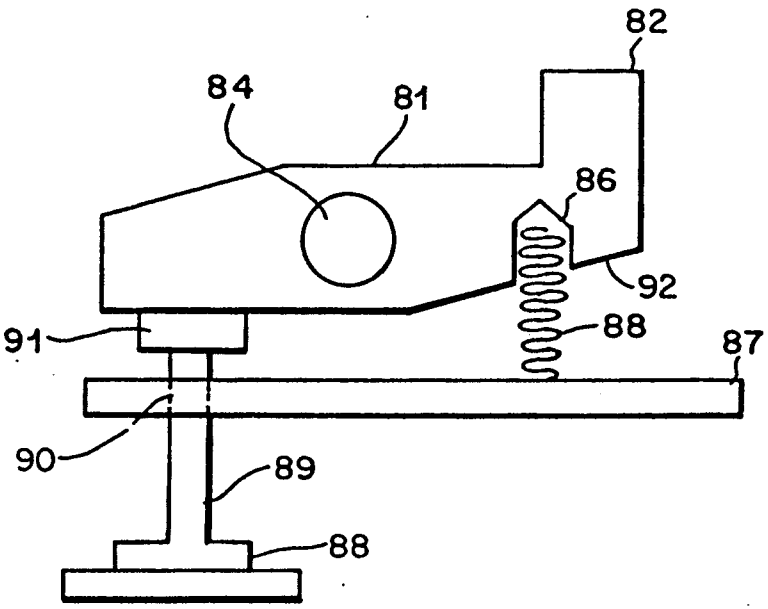

Referring to FIGS. 1 to 3 a shuttle apparatus according to the invention is shown generally by 11. The apparatus comprises a frame including longitudinal frame members 12, legs 13 and crosspiece 12*a*. The apparatus is disposed between a signature stacker shown generally by 14 and an off-line bundler receiving station shown generally by 15 in FIG. 3. The forward or upstream end of the frame members are mounted to stacker frame 25. The stacker 14 is connected to a feed conveyor shown generally by 16. The stacker 14 and bundler receiving station 15 are apparatus well-known in the art. The bundler receiving station consists of a table 23 having a plurality of rollers 24 mounted thereon. A typical stacker for use with this invention is described in U.S. Pat. No. 4,463,940. Prior to stacking, signatures moving in a stream in shingled fashion from the fly end of a printing press are jogged on a conveyor jogger, and passed through a pair of crusher rollers to remove air therefrom. They are then conveyed upwardly between a pair of H-belts 17 (one shown) which pass around a series of drive pulleys 18 and tension pulley 19. An array of compression rollers 20 maintain pressure on the signatures in their movement upwardly. At the top of the stacker, the signatures are stacked horizontally at the receiving station 21 of the stacker and passed onto the conveyor. A horizontal stack of signatures 22 is shown on the carriage of the invention which carriage will be more fully described below.

In the past, stacked signatures were pushed by hand across a table from the conveyor 16 to a position in front of the bundler receiving station. Thereafter, they were pushed in a direction normal to the table onto the rollers 24 of the bundler receiving station. Thereafter they are compressed and automatically bundled.

The present invention, on the other hand, provides a shuttle system for the off-line conveying of stacked signatures 22 from the stacker 14 to the bundler receiving station 15.

Figures 8A, 8B:
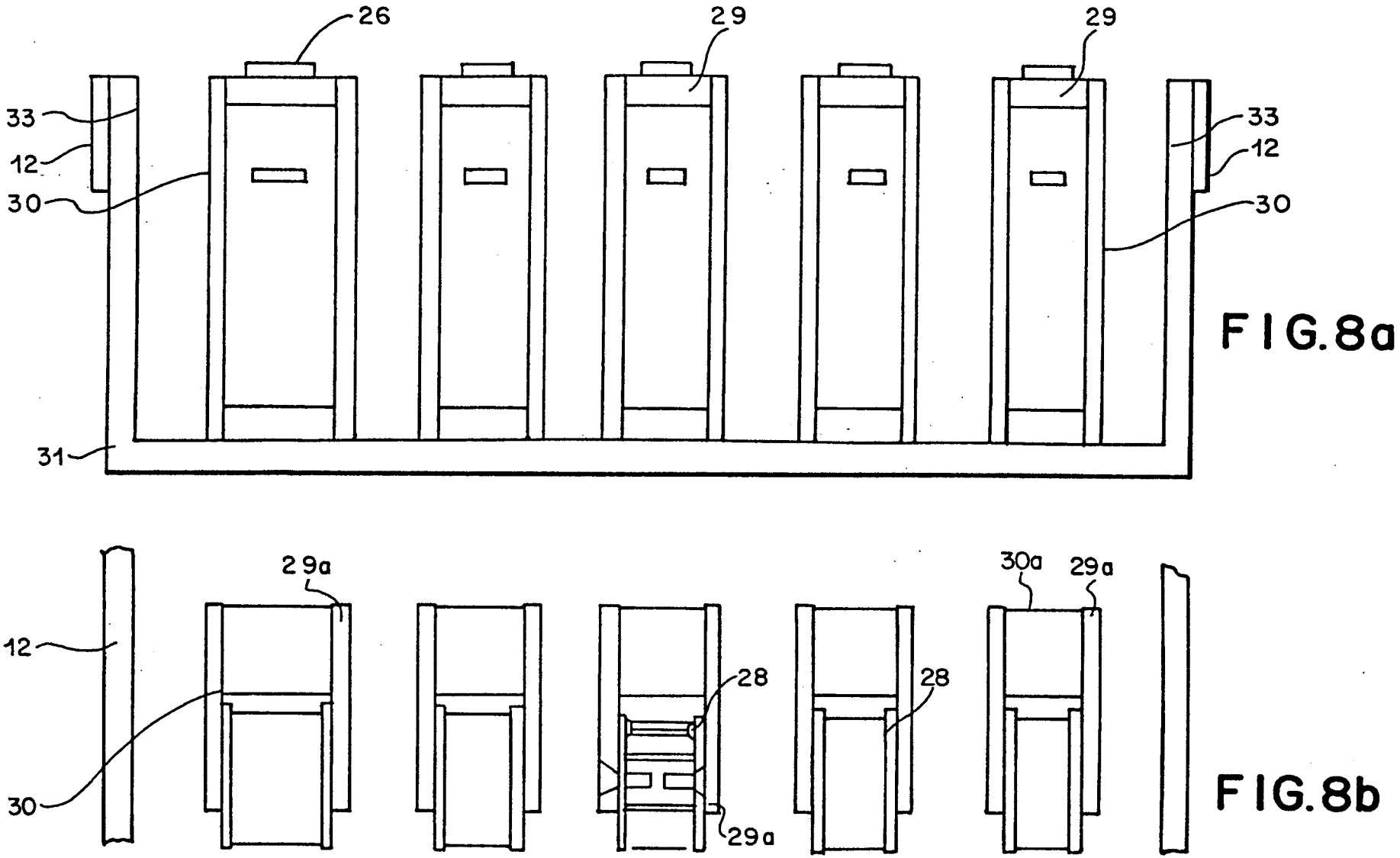
FIG. 8A shows a section of the conveyor of the apparatus through line 8—8 of FIG. 1.
FIG. 8B shows a top view of the conveyor tension pulleys.

Horizontally stacked signatures from the receiving station 21 of the stacker are transported downstream by conveyor 16. Referring additionally to FIGS. 8A and 8B the signatures are conveyed by endless belts 26 (5) driven by drive pulleys 27 secured to the stacker frame and tensioned by idler pulleys 28 mounted on tension brackets 29. Each belt is supported underneath by a longitudinal support section 29 to which brackets **29*a* are attached. The support sections are mounted on hollow columns 30 supported by spacer blocks 30*a* which columns are in turn supported by crosspiece 31 mounted to the bottom of frame members 12 by hanger 33. Another crosspiece and hanger assembly is mounted downstream of hanger 33 and crosspiece 31 to further support the columns (not shown). The pulleys 27 and 28 are rotatably mounted inside the columnar supports. A gap 35** is formed between each pair of conveyor belts, the importance of which will be described hereafter.

Referring to FIGS. 1, 2 and 3, a shuttle carriage 36 and carriage lift apparatus 37 is shown. The shuttle carriage 36 is a wheeled vehicle which rides on tracks 38. The carriage consists of four vertical support segments 39 mounted on vertical uprights 40. The vertical uprights are connected to crossbrace 45. The tracks 38 are braced at the forward and rearward ends of the frame members 12 by crosspieces 41 and 42, respectively, mounted under the frame members 12 and are supported by lift supports 50 and 51 on the lift mechanism 37. Each upright 40 has extension pieces 43 mounted above each carriage segment 39. A vertically disposed roller 44 is mounted between each extension piece. The purpose of the roller is to support the stacked signatures and to allow ease of movement off the carriage to the bundler receiving station 15. Each carriage segment 39 has wheels 46 mounted on its lower end by axle pin 47. Each wheel 46 rolls along a rail 48 of each track 38 and is kept in position on the rail by rail guides 49. Each carriage segment 39 is spaced so that it will register with the gap 35 between belts 26. A series of five horizontally mounted rollers 52 are mounted at about belt level height between the segments 39 which register with the belts 26. Because tracks 38 run substantially along the length of the frame the carriage 36 can be shuttled between crosspieces **12*a* and the conveyor 16, the segments 39 moving between roller 52 and belts 26. FIG. 1 shows a horizontal stack of signatures 22 on the carriage at the conveyor 16. The carriage is also shown by dotted lines at the crosspiece 12*a***. It should also be mentioned that the carriage can be made of any desired length depending on the number of signatures to be transported from the stacker and the dimensions of the bundler receiving station.

The lift apparatus 37 for the invention shown in FIGS. 1 and 2, comprises a pneumatically-actuated system for raising and lowering tracks 38 on which carriage segments 39 ride. A pair of hangers 53 are mounted on frame members 12 extending below the members. Cross-shaft 54 is rotatably mounted between hangers 53. Spanning the cross-shaft 54 and mounted thereto are horizontal support segments 55 pivotably mounted to vertical support sections 56 by means of axle pins 57. The vertical support sections 56 are mounted to cross-support 51 by bolts 58. An allen screw 59 secures each track 38 to the cross-support. Cross-support 50 is similarly mounted to a cross-shaft, wherein like elements are designated by like-reference numerals and the letter a. Linkage arms 60 and **60*a* are mounted on shafts 54 and 54*a*. Each linkage arm 60 and 60*a* is connected to lift actuator rod 61 via coupling 62 containing adjusting bolt 63 threadably engaging the coupling 62 and rod 61. The coupling 62 is rotatably mounted to linkage arm 60 via spherical bearing 64 having jam nut 65. Between hangers 53 and section 55 on the other side of shaft 54 is mounted lift arm 66 which is connected with cylinder rod 67 via coupling 68 and spherical bearing 69 having jam nut 70. Spherical bearings 64 and 69 accomodate misalignments of couplings 62 and 68 to arms 60 and 66, respectively. Hanger 71*a* mounted on frame member 12 is connected to double-acting pneumatic cylinder 71 via extension 72 and bracket 73 through cylinder extension 74. Bracket 73 extends from hanger 71*a* on the frame 12. The cylinder 71 contains piston 75 and air inlets 76 and 77**.

Operation of the lift apparatus in conjunction with the shuttle carriage is as follows. When horizontally-stacked signatures reach the conveyor 16 the carriage is normally located distant from the conveyor, as for example, against crosspiece **12*a* as shown by the dotted lines in FIG. 1. The carriage tracks 38 are then lowered by admitting compressed air to inlet 77 which moves piston 75 upwardly. This causes rod 67 to move arm 66 to the right turning shafts 54 and 54*a* counterclockwise. This in turn lowers supports 51 and 50 under tracks 38. The shuttle segments 39 are lowered to a level below the conveyor belts 26 and supports 29. The carriage is then moved to the left until the shuttle segments are under the signature stack. Then, air is admitted to inlet 76 to move piston 75 downwardly causing supports 51 and 50 to raise segments 39 and support the stacked signatures on the carriage as shown in FIG. 1. The carriage is then moved to the crosspiece 12*a* in front of the bundler receiving station 15. Air is then admitted to inlet 77 to lower the tracks and carriage and the stacked signatures are caused to rest on rollers 52. From there they are pushed to the bundler receiving station along rollers 44**.

Referring to FIGS. 3, **4*a* and 4*b*, there is shown a latch mechanism for latching the carriage 36 to the crosspiece 12*a* while the signatures are off-loaded to the bundler receiving station. The latch mechanism is particularly useful in conjunction with the carriage counterweight system to be described hereafter. The latch mechanism is shown unconnected to crosspiece 12*a* by solid lines and connected to keeper 80 mounted on crosspiece 12*a*** by dotted lines.

The latch mechanism comprises a body 81 having an extension 82 whose surface 83 is angled at an angle of about 30°. The body is provided with a central pivot bore 84 and is connected to crossmember 45 by pivot pin 85 as shown in FIG. 3. The body also has a spring recess 86. A brace 87 is mounted on member 45 and has spring 88 connected thereto which is inserted in recess 86 thus biasing body 81 in a counterclockwise direction.

The body also has angled surface 92 to allow clearance in moving over the keeper. Bracket 87 is also provided with a handle 88 the shaft 89 of which passes through a bore 90 in bracket 87 on the side of pivot bore 84 opposite the spring 88. A plunger 91 mounted on the end of shaft 89 butting against the body 81.

When the carriage 36 approaches crosspiece 12*a* the latch engages keeper 80 and sliding surface 83 slides over the keeper clockwise until the surface clears the keeper. The spring tension of spring 88 then forces the body back to its original position behind the keeper as shown by the dotted lines in FIG. 3. Release of the latch is accomplished by pushing in on the handle 88 moving the plunger against the latch body to rotate the body clockwise clear of the keeper. The carriage is then moved back to the conveyor belts.

Figure 5:
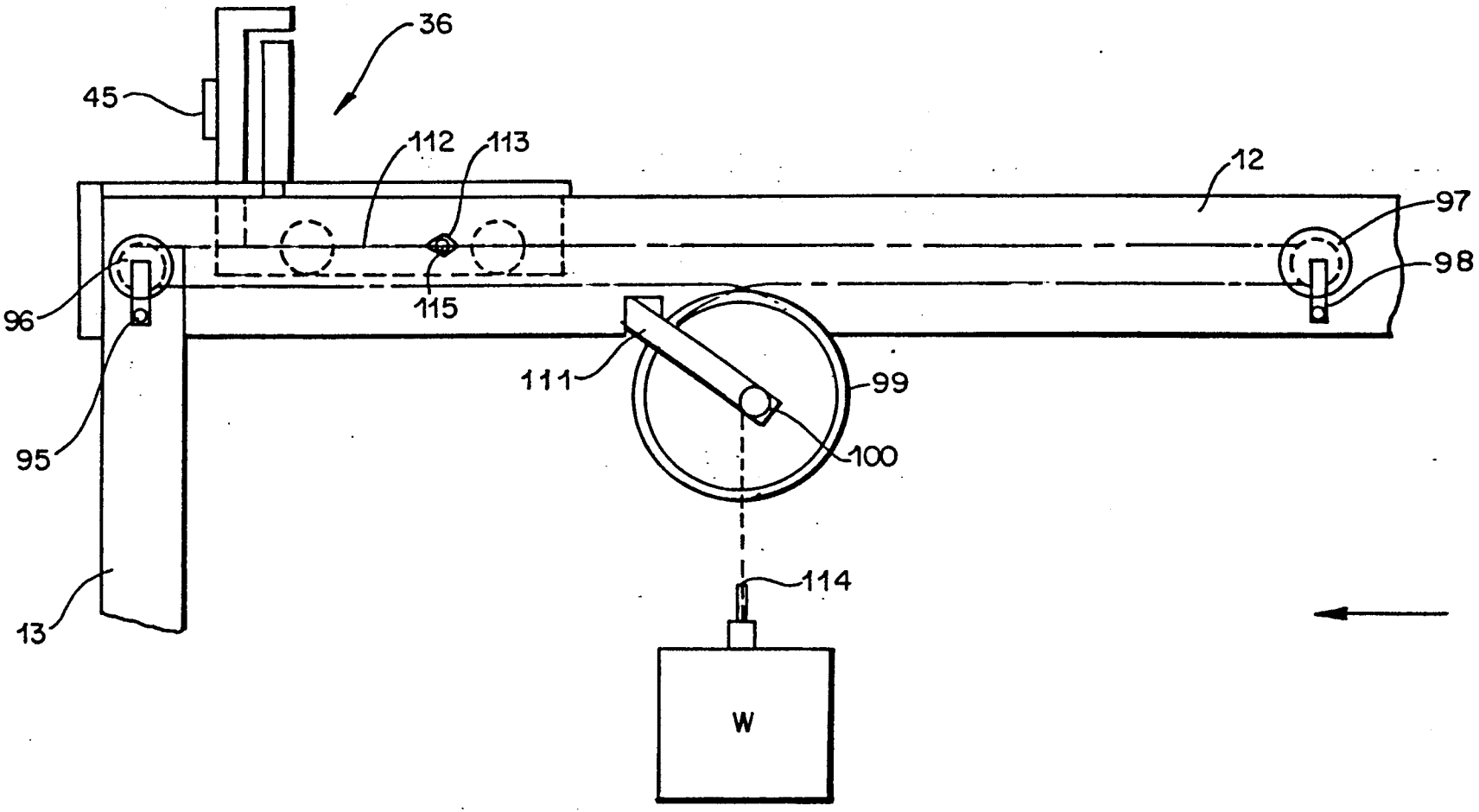
FIG. 5 is a side view of a counterweight system for biasing the movement of the carriage assembly in the upstream direction.

FIG. 5 shows a counterweight system for biasing the carriage 36 in the direction opposite to the movement of signatures from the stacker to the bundler receiving station, that is in a direction opposite to that shown by the arrow; toward the conveyor 16.

Mounted to leg 13 on bracket 95 is pulley 96 and a second pulley 97 is mounted on frame 12 near the stacker or conveyor by bracket 98. A spool 99 having shaft 100 is mounted to the frame 12 by bracket 111. A metal wire 112 connected to grommet 113 which is bolted to the carriage passes over pulley 96, around spool 99, then around pulley 97 to the grommet again. A weight W is suspended from wire 114 which is coiled around shaft 100.

The weight W causes shaft 100 and spool 99 to turn counterclockwise. The wire around pulleys 96 and 97 moves clockwise and drives shuttle carriage 36 to the right. This counterweight biasing system is particularly useful with the latch mechanism hereinbefore described.

Thus when signatures are transported from the conveyor 16 to the bundler receiving station 15 the latch mechanism prevents the carriage from being moved back toward the conveyor by the counterweight system. The operator can then unload signatures from the carriage without having to hold the carriage in place. After unloading, the latch is released and the carriage automatically returns to the conveyor urged by the counterweight system.

Figure 6:
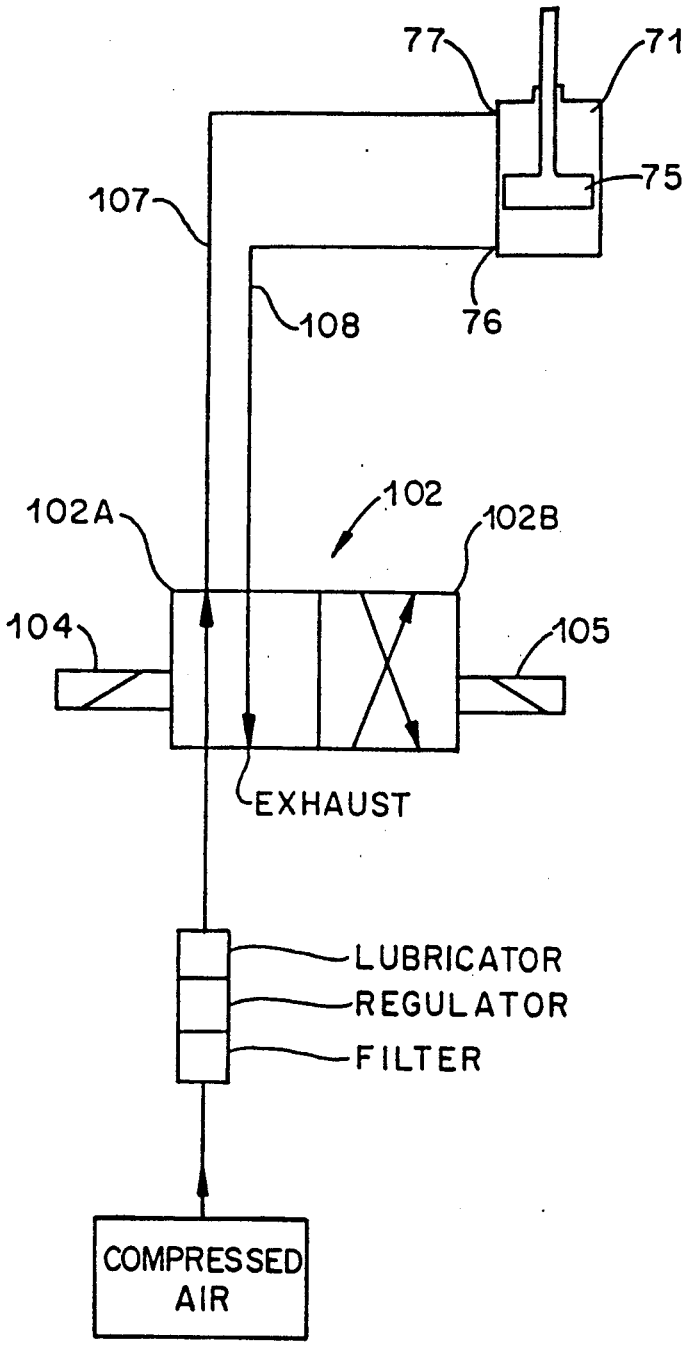
FIGS. 6 and 7 are diagrams of an electro-pneumatic system for semiautomatic operation of the shuttle apparatus.
Figure 7:
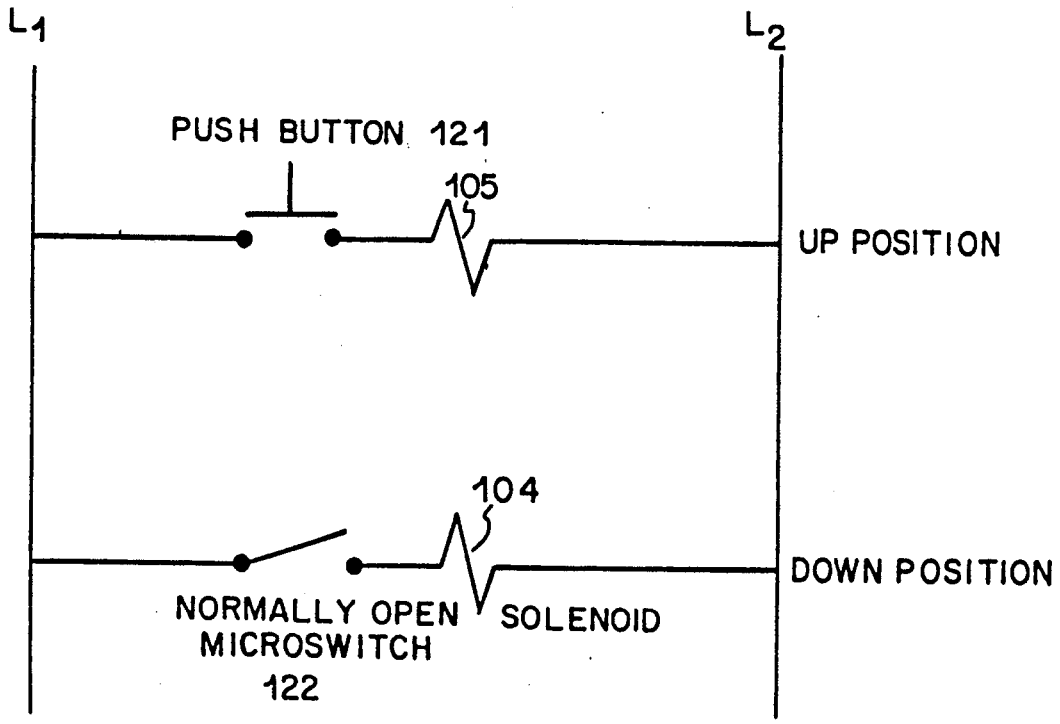

The raising and lowering of the carriage can be accomplished semiautomatically by using an electropneumatic system. Referring to FIGS. 1, 3 and 7, a push-button switch 121 may be located on the stacker frame and a microswitch 122 having actuator 123 which is normally open can be located on crosspiece 12*a*. FIG. 6 is a block diagram of the pneumatic and electronic circuitry used to raise and lower the carriage 36.

Assuming the carriage tracks 38 are in the down position and the carriage is located under the conveyor 16, the operator presses push-button 121 which activates solenoid 105 and deactiviates solenoid 104. Valve 102 is placed in the 102*b* position and compressed air in line 108 enters inlet 76 to advance piston 75 downward; thus, raising the shuttle carriage and picking up the signatures on the segments 39. When the shuttle carriage is moved against crosspiece 12*a* the carriage engages the rod 123 of microswitch 122 as the carriage is latched. The microswitch activates solenoid 104 and deactivates solenoid 105. Valve 102 moves to the 102A position and compressed air is fed through lines 107 to inlet 77. The cylinder piston 75 then retracts and the tracks of the carriage are lowered to deposit the signature on rollers 52. The signatures are then moved to the bundler receiving station. The carriage is then unlatched and is urged to the conveyor 16 by the counterweight system.

We claim:

1. An apparatus for transporting paper sheet material in signature form comprising:

(a) a horizontal frame;

(b) a conveyor mounted in said frame comprising a plurality of horizontally disposed belts for receiving said material to form a stack of signatures on said belts, said belts being spaced apart to form gaps therebetween;

(c) a plurality of tracks mounted horizontally in said frame and extending under said conveyor;

(d) means for raising and lowering said tracks;

(e) a carriage having a plurality of connected vertical support segments and wheels which ride on said tracks, said segments being aligned with said gaps between said belts, said segments occupying a first position below said conveyor belts when said tracks are lowered by said means for raising and lowering and a second position above said conveyor belts when said tracks are raised by said means for raising and lowering, said segments in said second position lifting the stacked signatures from the conveyor; and (f) a plurality of horizontally disposed rollers mounted in said frame above said tracks, said rollers being in longitudinal alignment with said conveyor belts.

2. An apparatus for transporting paper sheet material in signature form comprising:

(a) a horizontal frame;

(b) a conveyor mounted in said frame comprising a plurality of horizontally disposed belts for receiving said material to form a stack of signatures on said belts, said belts being spaced apart to form gaps therebetween;

(c) a plurality of tracks mounted horizontally in said frame and extending under said conveyor;

(d) means for raising and lowering said tracks; and (e) a carriage having a plurality of connected vertical support segments and wheels which ride on said tracks, wherein said carriage further comprises an upright member extending above each segment having a vertically disposed roller mounted thereon, said segments being aligned with said gaps between said belts, said segments occupying a first position below said conveyor belts when said tracks are lowered by said means for raising and lowering and a second position above said conveyor belts when said tracks are raised by said means for raising and lowering, said segments in said second position lifting the stacked signatures from the conveyor.

3. An apparatus for transporting paper sheet material in signature form comprising:

(a) a horizontal frame;

(b) a conveyor mounted in said frame comprising a plurality of horizontally disposed belts for receiving said material to form a stack of signatures on said belts, said belts being spaced apart to form gaps therebetween;

(c) a plurality of tracks mounted horizontally in said frame and extending under said conveyor;

(d) means for raising and lowering said tracks;

(e) a carriage having a plurality of connected vertical support segments and wheels which ride on said tracks, said segments being aligned with said gaps between said belts, said segments occupying a first position below said conveyor belts when said tracks are lowered by said means for raising and lowering and a second position above said conveyor belts when said tracks are raised by said means for raising and lowering, said segments in said second position lifting the stacked signatures from the conveyor; and (f) a crossmember mounted on said frame located distant from said conveyor to act as a stop for said carriage, said carriage being provided with a pivotably mounted latch to releasably retain said carriage at said crossmember, said latch having a body, a body extension having a sliding surface, means for biasing said body in one direction of movement, and a handle engaging said body for moving said body in a direction opposed to said one direction of movement.

4. An apparatus for transporting paper sheet material in signature form comprising:

(a) a horizontal frame;

(b) a conveyor mounted in said frame comprising a plurality of horizontally disposed belts for receiving said material to form a stack of signatures on said belts, said belts being spaced apart to form gaps therebetween;

(c) a plurality of tracks mounted horizontally in said frame and extending under said conveyor;

(d) means for raising and lowering said tracks;

(e) a carriage having a plurality of connected vertical support segments and wheels which ride on said tracks, said segments being aligned with said gaps between said belts, said segments occupying a first position below said conveyor belts when said tracks are lowered by said means for raising and lowering and a second position above said conveyor belts when said tracks are raised by said means for raising and lowering, said segments in said second position lifting the stacked signatures from the conveyor; and (f) means for biasing said carriage for movement along said tracks in one direction.

5. The apparatus of claim 4 wherein said means for biasing comprises a counterweight to said carriage.

6. The apparatus of claim 5 wherein said means for biasing comprises:

(a) a pair of spaced pulleys mounted on said frame;

(b) a spool mounted on said frame between said pulleys having a shaft;

(c) a weight connected by a wire coiled around said shaft;

(d) a connecting member mounted to said carriage; and (e) a wire connected at one end to said connecting member, passing around said one of said pulleys, around said spool, around said other of said pulleys and connected again to said connecting member.

* * * * *